US006944311B2

(12) United States Patent
Nishikawa et al.

(10) Patent No.: US 6,944,311 B2
(45) Date of Patent: Sep. 13, 2005

(54) SPEAKER FOR VEHICLE

(75) Inventors: Akira Nishikawa, Hyogo (JP); Akira Motojima, Hyogo (JP); Hiroyuki Yoshii, Nara (JP)

(73) Assignee: Fujitsu Ten Limited, Kobe (JP)

( * ) Notice: Subject to any disclaimer, the term of this patent is extended or adjusted under 35 U.S.C. 154(b) by 22 days.

(21) Appl. No.: 10/449,668

(22) Filed: Jun. 2, 2003

(65) Prior Publication Data

US 2003/0228022 A1 Dec. 11, 2003

(30) Foreign Application Priority Data

Jun. 7, 2002 (JP) ..... 2002-167798

(51) Int. Cl.[7] ..... H04R 25/00
(52) U.S. Cl. ..... 381/389; 381/124; 381/395
(58) Field of Search ..... 381/302, 386, 381/389, 395, 396–397, 124, 162; 181/175, 179

(56) References Cited

U.S. PATENT DOCUMENTS 977,616 A * 12/1910 Gottschalk ..... 381/386
1,954,966 A * 4/1934 Thuras ..... 381/413
4,230,907 A * 10/1980 Hasselbach et al. ..... 381/397
6,724,909 B2 * 4/2004 Tsumori et al. ..... 381/412
6,751,330 B2 * 6/2004 Kowaki et al. ..... 381/354
2002/0057821 A1 5/2002 Tsumori et al.

FOREIGN PATENT DOCUMENTS

JP 2000-013884 1/2000
JP A 2002-152884 5/2002

* cited by examiner

*Primary Examiner*—Suhan Ni
(74) *Attorney, Agent, or Firm*—Oliff & Berridge, PLC

(57) ABSTRACT

A speaker for vehicle has a weight mounted on the backside of a magnetic circuit of a speaker unit. The weight includes a weighting part having a shape in which the thickness in an axial line of the speaker unit is made small and the diameter in a direction perpendicular to the axial line is extended. The outer diameter of the weighting part is made longer than that of the magnetic circuit. The weighting part has a peripheral edge extending forward in the axial direction to cover the outer periphery of the magnetic circuit at least partially. Where a frame of the speaker unit is provided with an opening, the weight is designed to have a shape and position so as not to face the opening.

7 Claims, 5 Drawing Sheets

Related Art

Related Art

SPEAKER FOR VEHICLE

BACKGROUND OF THE INVENTION

1. Field of the Invention

This invention relates to a speaker to be mounted on a vehicle (hereinafter referred to "speaker for vehicle"), which is applicable to car-audio.

2. Description of the Related Art

As seen from FIG. 5, conventionally, a vehicle 1 such as a passenger car has various speakers for car audio. Generally, since a passenger in a room 2, such as a driver of the vehicle 1 basically listens to left-right two-channel stereophonic reproduction in a posture facing forward of the vehicle 1, speakers 3 and 4 are mounted in spaces in left and right front doors 5 and 6. However, since the door spaces are not so large, bass speakers are mounted in a space of a rear trunk room of the vehicle in a manner that they are opened in an upper rear tray 7. Since the directionality of an acoustic output is not so conspicuous at a low frequency, stereophonic feeling will not be deteriorated so much in monophonic reproduction based on left and right synthesis in a bass range. In case where front-rear and left-right four or more channel stereophonic reproduction is performed, left and right speakers are arranged in the rear tray 7 and rear doors 9 and 10 at the rear of the vehicle 1.

The speakers 3 and 4 mounted in the front doors 5 and 6 may cover the reproduction of a frequency range varying according to a system format of a car stereo, but may probably cover the frequency range of a midrange including the main part of a voice. Such a frequency range is the main part of the reproduced sound and is required to have high quality. In order to improve the sound quality of the speaker, it is necessary to suppress the vibration in the other portion than a diaphragm as well as to flatten the reproduction frequency characteristic and reduce the distortion.

FIG. 6 shows a structure corresponding to a speaker apparatus disclosed in FIG. 1 of JP-A-2002-152884. FIG. 6 shows a side-sectional view at the upper half and a side view at the lower half. A speaker unit 12 of the speaker apparatus 11 serves to suppress the vibration due to sound emission from a diaphragm 14 with the aid of a weight 13 mounted on the backside. A magnetic circuit 5 of an external magnetizing type generates a strong magnetic field in a magnetic gap through a ring-shaped main magnet 16 made of ferrite, a center pole 17 and a plate 18 so that the electromagnetic force corresponding to the current flowing through a voice coil 19 is generated in the direction of an axial line 19*a*, thereby driving a diaphragm 14 supported vibratably by a frame 20.

In order to suppress the outer leakage of magnetism, the magnetic circuit 15 also includes a cancel magnet 21, which is made of ferrite and magnetized in an opposite direction to the main magnet 16, and a shield cover 22. The center pole 17, plate 18 and shield cover 22 are made of a ferromagnetic material such as iron and also referred to as a yoke.

The outer periphery of the top end of the diaphragm 14 is supported by an edge 23 of the frame 20 whereas the base end of the center of the diaphragm 14 is supported by a damper 24 of the frame 20 that also has a function of damping vibration. The base end of the diaphragm 14 is coupled with the tip of a bobbin of the voice coil 19, its opening is closed by a dust cap 25. A gasket 26 is provided on the outer periphery so that the edge 23 is not crushed owing to pushing during attachment.

The weight 13 is made of e.g. iron, and has a mass e.g. 1.5 times as heavy as the mass of the entire speaker unit 12. The weight 13 has a schematically cannonball shape, and a flat end face on the front side and a streamline curve on the backside. The sectional shape of the weight 13, which is vertical to the axial line 19*a*, has a smaller diameter than the maximum diameter of the magnetic circuit 15. From the center of the end face on the front side of the weight 13, a boss 27 protrudes. The weight 13 is connected to the backside of a center pole 17 of the speaker unit 12 at only the tip of the boss 27. The weight 13 has a through-hole at the center which passes from the backside to the tip of the boss 27, into which a bolt 28 is inserted from the backside so as to be connected to the center pole 17. The bolt 28 is engaged with a screw hole formed in the center of the center pole 17. A flat washer 29 and a spring washer 30 provided at the head of the bolt 28 prevents the bolt 28 from loosening.

In the speaker unit 12, the magnetic circuit 15 and voice coil 19 constitute a converter for converting an electric signal into a mechanical vibration. The converter and diaphragm 14, which emits a sound wave on the front side thereof, are supported by the frame 20. The mechanical vibration converted from the electric signal by the converter is emitted as the sound wave into the ambient air from the diaphragm 14. The counterforce applied to the diaphragm 14 from the ambient air returns to the converter. However, since the weight 13 having a larger mass than that of the speaker unit 12 is secured to the converter, the weight 13 serves as a virtual ground and hence the vibration is suppressed.

The speaker 3 and 4 as shown in FIG. 5 usually has a structure in which the frame of the speaker is screw-secured to a wall of a vehicle body, the wall defining a passenger room 2. In this structure, the magnetic circuit which generates counter force against the motion of the diaphragm for generating sound is likely to vibrate. This attenuates the efficiency of transmitting energy from the diaphragm to the ambient air, thereby deteriorating the sense of speed which is a transient characteristic of the reproduced sound.

If the speaker apparatus as shown in FIG. 6 is employed as the speaker for vehicle 3, 4 of FIG. 5, it is expected that the sense of speed is improved and hence the sound quality is improved. However, there is possibility that the front doors 5 and 6 and rear doors 9 and 10 do not necessarily have their sufficient depth enough to accommodate the weight 13 as shown in FIG. 6.

SUMMARY OF THE INVENTION

An object of the present invention is to provide a speaker for vehicle capable of including a weight having a large mass without increasing the thickness on the backside of a speaker unit.

The present invention provides a speaker for vehicle which is installable in a space adjacent to a passenger room in a vehicle body, having: a diaphragm facing the passenger room; a conversion portion disposed on a backside of the diaphragm, the conversion portion converting an electric signal into a driving force for a mechanical displacement to be applied to the diaphragm; and a weight mounted on the backside of the conversion portion, wherein the weight includes: a coupling part coupled with a back part of the conversion portion; and a weighting part having a shape in which the length in a diameter direction extending perpendicularly to a depth direction that extends from the coupling part toward the back part is longer than that in the depth direction, and having a mass capable of suppressing a vibration of the conversion portion.

According to the invention, the speaker for vehicle can be installed in the space adjacent to the passenger room in the vehicle body. The conversion portion on the backside of the diaphragm facing the passenger room converts an electric signal into a driving force for a mechanical displacement to be applied to the diaphragm. When the diaphragm is driven mechanically by the conversion portion, the air in the passenger room on the front side of the diaphragm is pressed to emit an acoustic output as a change in pressure. The diaphragm suffers from the counterforce from the air, and the counter force is transmitted to the conversion portion. Since the weight is mounted on the backside of the conversion portion, it serves as a virtual ground against the vibration generated by the counterforce, and suppresses the vibration to improve the sound quality of the reproduced sound. The weight includes a coupling part and a weighting part. The coupling part is coupled with the back part of the conversion portion. The weighting part has a mass enough to serve as the virtual ground, and has a shape in which the length in the diameter direction extending perpendicularly to the depth direction is longer than the that in the depth direction extending from the coupling part toward the back part. Therefore, the speaker for vehicle can be installed in the space with a small depth such as the door portion of the vehicle body. The mass of the weighting part that serves as the virtual ground may be 1.5 times as heavy as the mass of the other parts of the speaker for vehicle excluding the weight. The mass of the weighting part is not limited to such the value, but may be a value that can suppress the vibration of the conversion portion.

In the present invention, the coupling part may be coupled with the back part on a straight line which passes the center of gravity of the conversion portion and extends in a direction of the displacement to be applied to the diaphragm.

According to this invention, since the coupling part is coupled with the back part of the conversion portion on a straight line which passes the center of gravity of the conversion portion, the weight can be effectively employed as a virtual ground.

In the present invention, the weighting part may have a shape which extends in the diameter direction around the coupling part more externally than the outer periphery of the conversion portion, and may have an edge located outside the outer periphery of the conversion portion and extending forward in a direction substantially parallel to the depth direction so as to cover at least a part of the outer periphery of the conversion portion.

According to this invention, even though the weight is mounted on the backside of the conversion portion, the weight has a shape in which the edge more external than the outer periphery of the conversion portion in the diameter direction extends forward in a direction substantially parallel to the depth direction so as to cover at least a part of the outer periphery of the conversion portion. Therefore, with the thickness reduced in the depth direction, a sufficient mass can be obtained. Where the frequency range not including the bass range, such as the midrange of the main part such as human voice is reproduced, the space on the backside of the diaphragm may be small. Therefore, using the space of the backside of the frame with making an opening formed in the frame small, the weight which has a reduced thickness in the vicinity of the coupling part but an increased mass at the edge of the weighting part can be mounted.

In the present invention, the weighting part may be formed within a predetermined region in a circumferential direction around the coupling part.

According to this invention, the weighting part of the weight is not formed on the entire backside of the magnetic circuit serving as a conversion portion, but formed within a predetermined partial region in a circumferential direction. In the door of the vehicle body, where the depth is short and the space for accommodating the door glass is also required, it becomes possible to prevent the weight from interfering with the door glass.

In the present invention, a frame supporting the diaphragm and the conversion portion may have an opening on a back part thereof, and the weighting part may be arranged at an area which does not face the opening.

In case where the speaker for vehicle reproduces the range from the midrange including the main part such as human voice to the low frequency range lower than the midrange, if the opening of the frame on the backside of the diaphragm is small or closed, the pressure of the air confined in the space on the backside greatly influences the quality of the reproduced sound. Therefore, the opening having a sufficient size is provided on the backside of the frame to dissipate the pressure on the backside of the diaphragm externally from the frame. In accordance with this invention, since the weighting part is arranged in the area where the frame is not opened on the backside, it does not influence the opening for dissipating the pressure on the backside of the diaphragm.

In the present invention, the weight may include a fixing member having the coupling part for fixing the weighting part to the conversion portion, and the weighting part may include a predetermined number of thin weight plates which are stacked to each other. Also, the weight may include a thin first weight plate having the coupling part and a predetermined number of thin second weight plates which are stacked to each other and fixed on the first weight plate.

According to this invention, a suitable number of weight plates are stacked in accordance with the depth assured in the space where the speaker for vehicle is accommodated, thereby improving the quality of the reproduced sound.

DETAILED DESCRIPTION OF THE PREFFERED EMBODIMENTS

Figure 1:
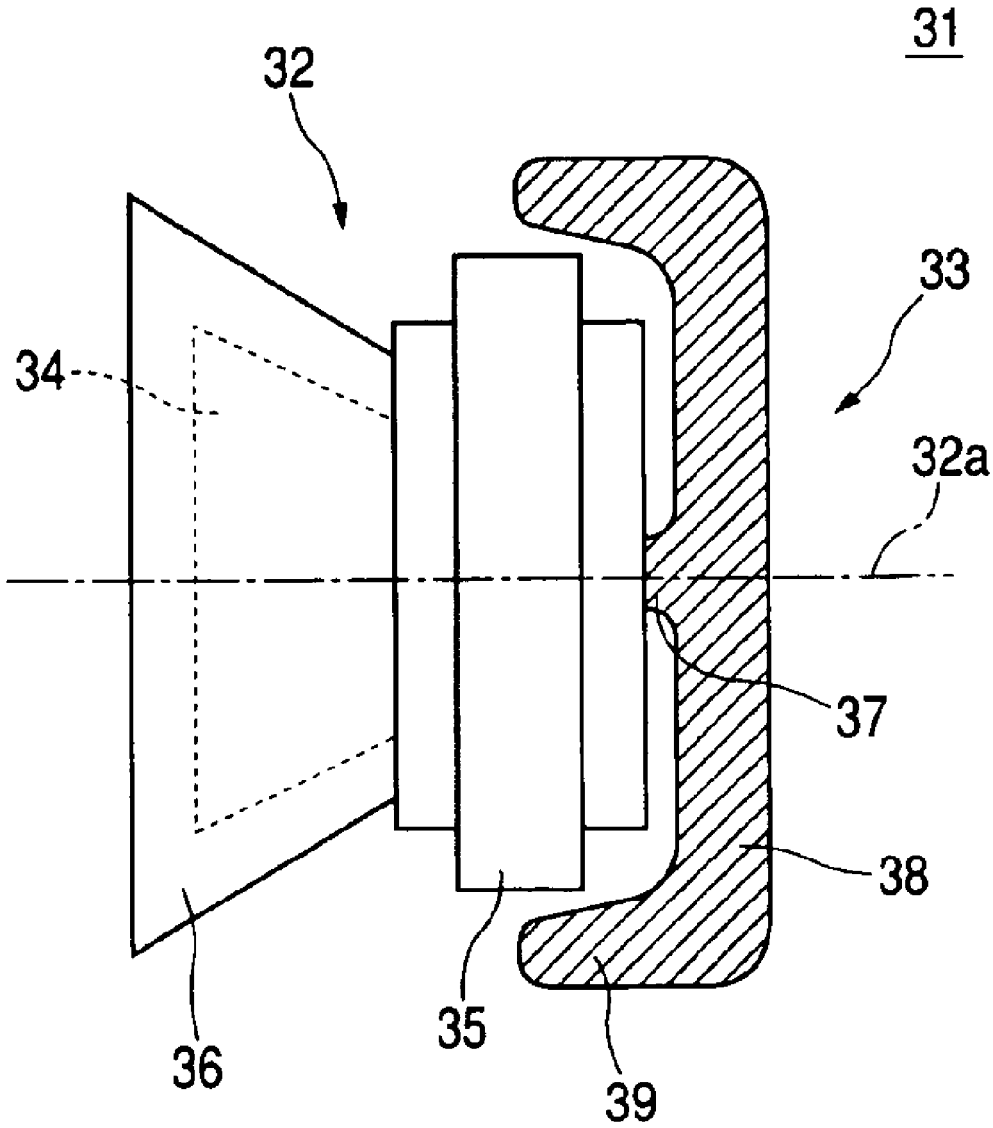
FIG. 1 is a side view, partially in section, of a speaker for vehicle according to an embodiment of this invention.
Figure 6:
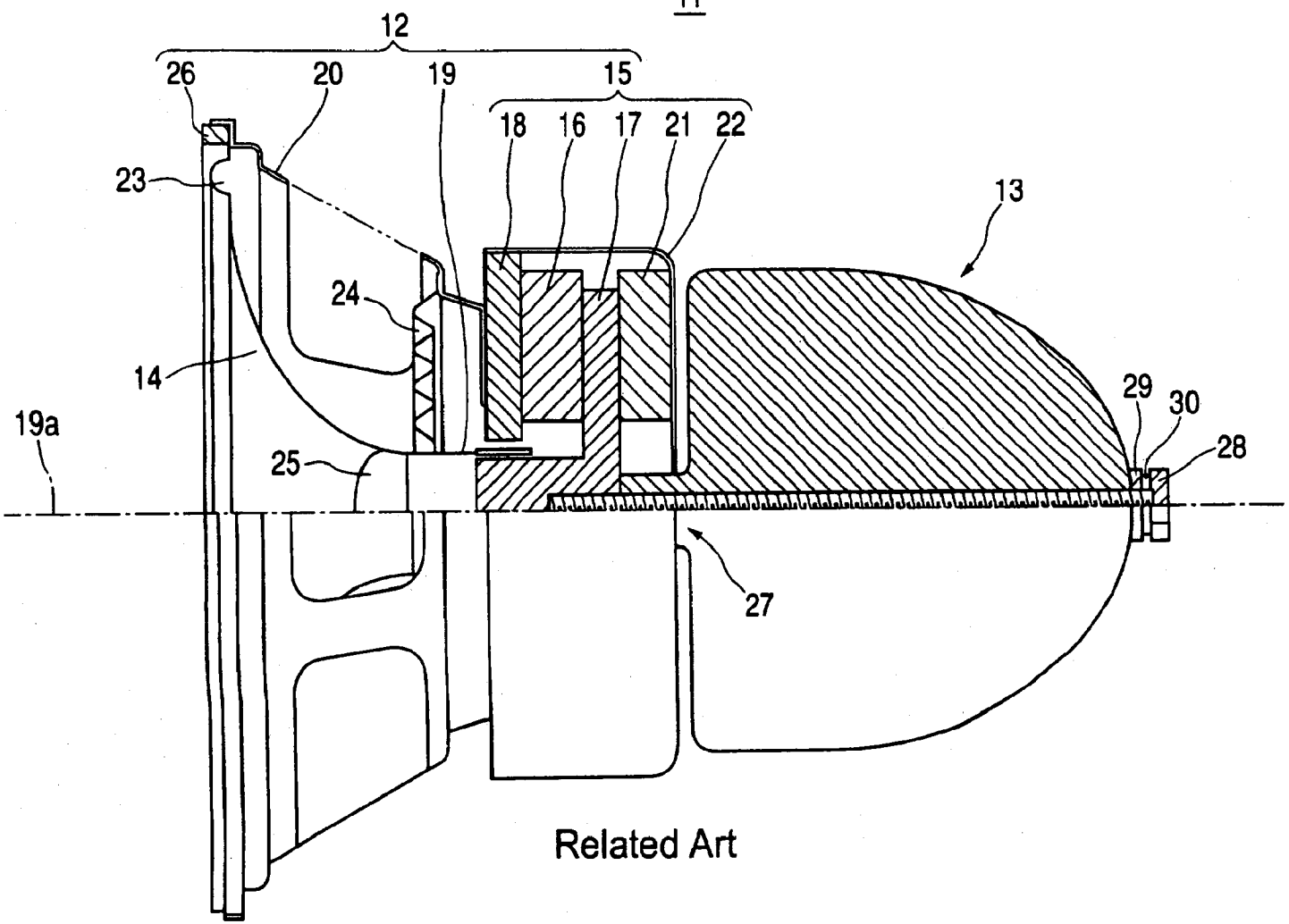
FIG. 6 is a side view, partially in section, of a conventional speaker apparatus for improving the sound quality by addition of a weight.

FIG. 1 shows the basic configuration of a speaker for vehicle 31 according to an embodiment of this invention. The basic configuration of a speaker unit 32 is similar to that of the speaker unit as shown in FIG. 6. The speaker unit 32 according to this embodiment is also provided with a weight 33 on the backside, which is a ground anchor serving as a virtual ground. The weight 33 is made of stainless steel or brass, which is a non-magnetic metal. The weight 33 is located on the backside of a magnetic circuit 35 that generates a magnetic field for driving a diaphragm 34. The speaker for vehicle 31 is installed in a space adjacent to a passenger room e.g. a door, in a vehicle body. The conversion portion, which includes a magnetic circuit 35 on the backside of the diaphragm 34 facing the passenger room, converts an electric signal into a driving force for a mechanical displacement to be applied to the diaphragm 34.

The speaker unit 32 according to this embodiment is designed to reproduce the frequency range of a midrange and further a treble range of several hundreds of Hz or higher and not to reproduce the bass range with a wide amplitude. In the low frequency range, the directionality of the reproduced sound is not so conspicuous, but a large space is required. Therefore, in a passenger car, the speaker for reproduction of the bass range is installed in e.g. a space on the rear side of the passenger room. Where the speaker unit 32 does not reproduce the bass range, in a frame 36, an opening for relieving the back pressure of the diaphragm 34 can be reduced in size. The space behind the frame 36 of the speaker unit 32 does not contribute to the acoustic reproduction so that the weight 33 in this embodiment uses this space to shorten the depth.

Specifically, a coupling part 37 of the weight 33 which protrudes like a boss is coupled with the central portion on the backside of the magnetic circuit 35 through which a central axial line 32*a* of the speaker unit 32 penetrating through the diaphragm 34 and magnetic circuit 35 passes. For example, by engaging a male screw formed on the coupling part 37 with a female screw formed on the backside of the magnetic circuit 35, the coupling part 37 can be easily coupled with the magnetic circuit 35. The mass required for the weight 33 to serve as a virtual ground is given to a weighting part 38. The mass of the weighting part 38 is made, for example, approximately equal to or larger than that of the speaker unit 32. In order to assure the necessary mass with the thickness reduced in the direction of the axial line 32*a* of the speaker unit 32, the weighting part 38 is enlarged toward the outer periphery in a diameter direction perpendicular to the axial line 32*a*. The diameter of the weighting part 38 is made longer than the outer diameter of the magnetic circuit 35. The portion of the peripheral edge 39 which exceeds the outer diameter of the magnetic circuit 35 is also extended forward so that the mass can be increased with a small depth on the backside. The peripheral edge 39 of the weight 33 approaches the back of the frame 36, but this does not influence the acoustic reproduction since the frame 36 has no opening.

Figure 2:
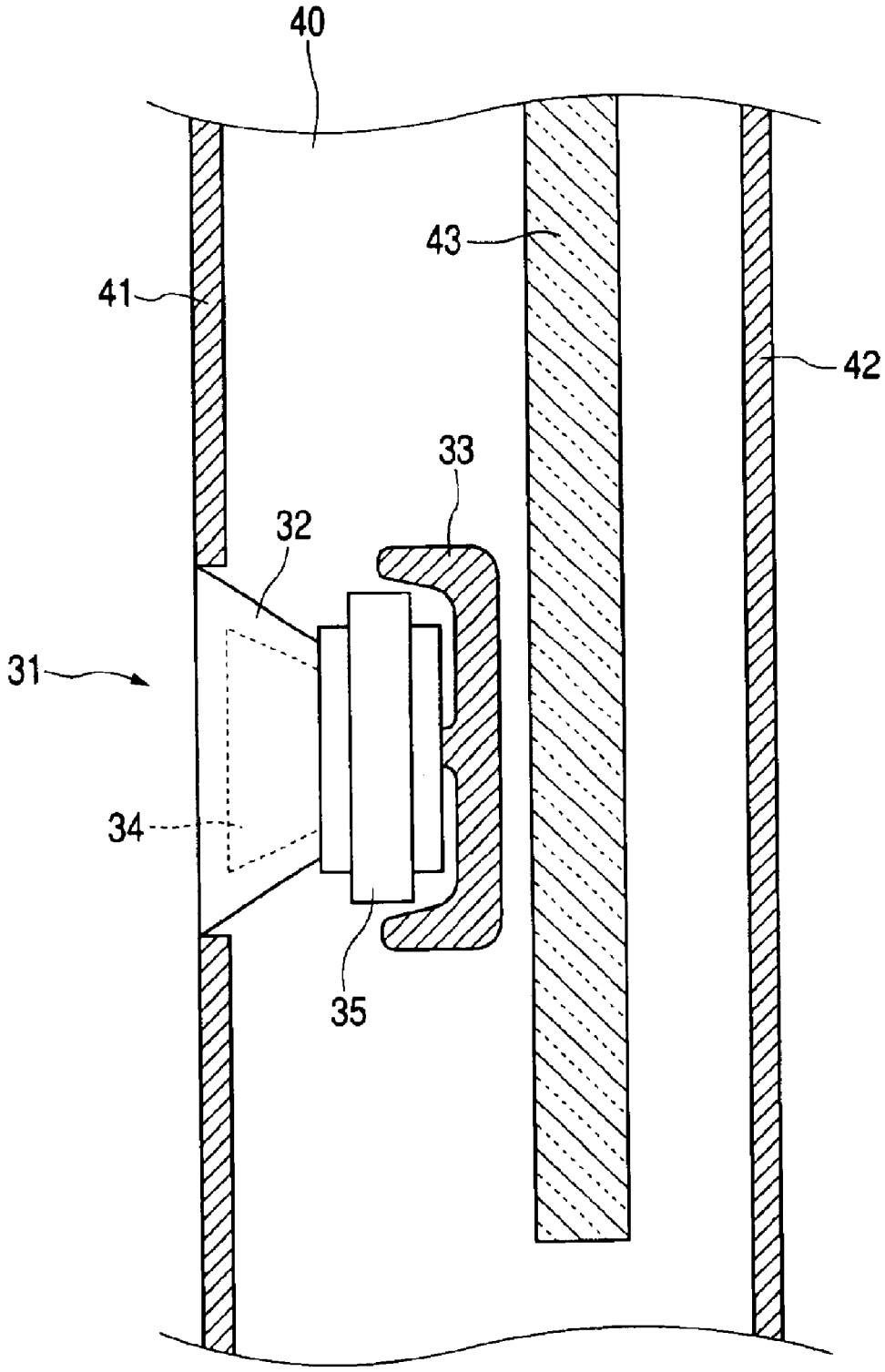
FIG. 2 is a schematic sectional view of the state where the speaker for vehicle of FIG. 1 is installed in a vehicle door.

FIG. 2 shows the state where the speaker for vehicle 31 as shown in FIG. 1 is installed in a door 40 of the vehicle body. The door 40 has a space between an interior member 41 that faces the passenger room and a side plate 42 that faces the exterior of the vehicle body. This space accommodates a door glass 43 when it is lowered. The speaker for vehicle 31, in which the weight 33 is small in thickness, does not interfere with the door glass 43 when the door glass 43 is lowered. Thus, the speaker for vehicle 31 can be accommodated in the space in the door 40. The speaker unit 32 is fit in an opening provided in the interior member 41. Because of the function of the weight 33 as a virtual ground, the vibration of the speaker unit 32 is suppressed so that the acoustic output can be effectively taken out from the diaphragm 34 to acquire the reproduced sound with a sense of speed in the main range in vocal and various musical instruments.

More specifically, the speaker for vehicle 31 according to this embodiment is installed in a space adjacent to the passenger room in the vehicle body. The conversion portion on the backside of the diaphragm 34 facing the passenger room converts an electric signal into a driving force for a mechanical displacement to be applied to the diaphragm 34. When the diaphragm 34 is driven mechanically by the conversion portion, the air in the passenger room on the front side of the diaphragm 34 is pressed to generate the acoustic output as a change in pressure. The diaphragm 34 suffers from the counterforce from the air, and the counterforce is transmitted to the conversion portion. Since the weight 53 is mounted on the backside of the conversion portion, it serves as a virtual ground against the vibration generated by the counterforce, and suppresses the vibration to improve the sound quality of the reproduced sound. The weight 33 is composed of a coupling part 37 and a weighting part 38. The coupling part 37 is coupled with the back of the conversion portion on a straight line of the axial line 32*a* which passes the center of gravity of the conversion portion and extends in the direction of displacement applied to the diaphragm 34. The weighting part 38 has a mass enough to serve as the virtual ground, and has a shape in which the length in the diameter direction extending perpendicularly to the depth direction is longer than the thickness in the depth direction extending toward the backside from the coupling part 37. Thus, the speaker for vehicle 31 can be installed in the space with a small depth such as the portion of the door 40 of the vehicle body.

Figure 3B:
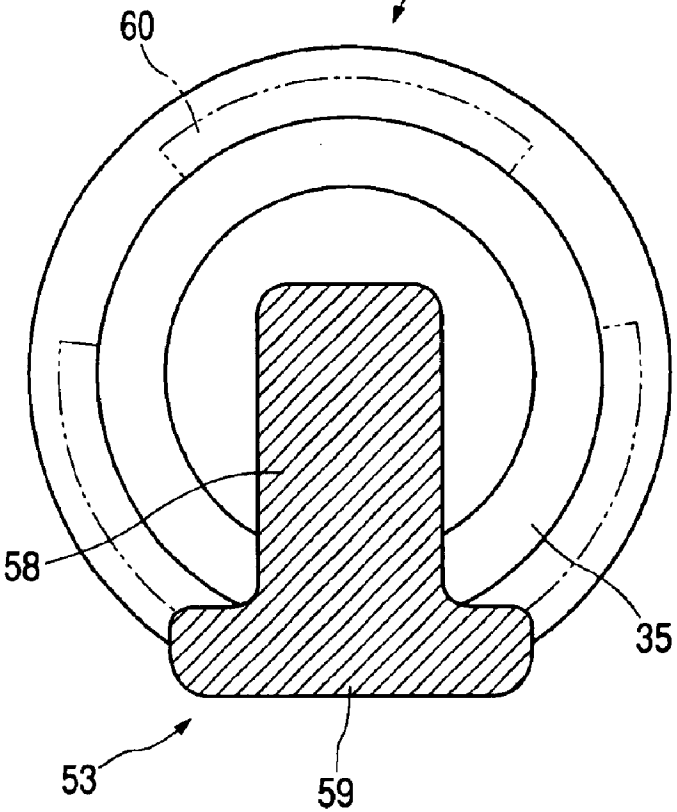
FIG. 3B is a rear view of the speaker for vehicle.
Figure 3A:
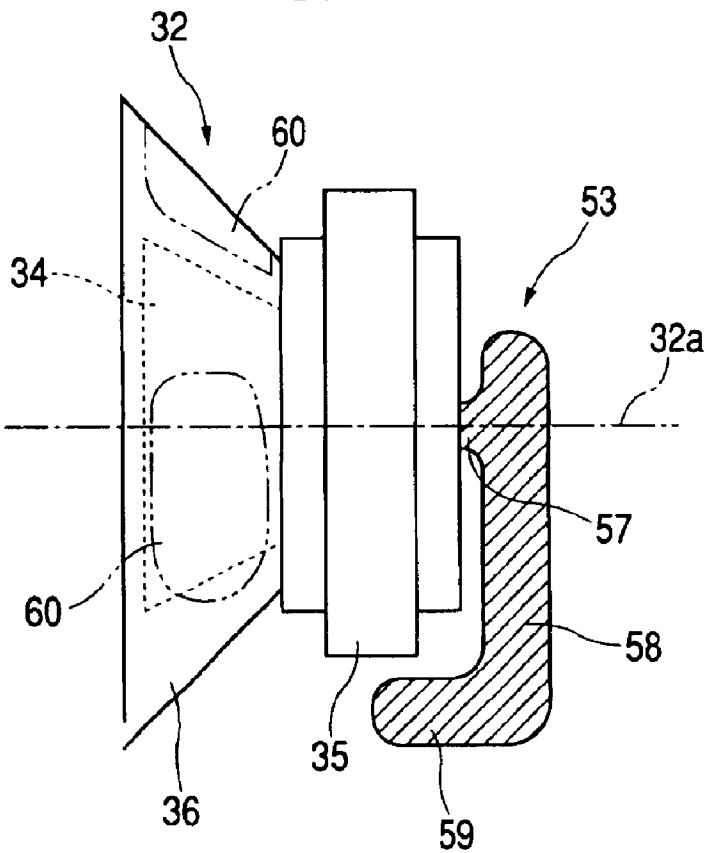
FIG. 3A is a side view, partially in section, of a speaker for vehicle according to another embodiment of this invention.

FIG. 3 shows a schematic arrangement of a speaker for vehicle 51 according to another embodiment of this invention. In this embodiment, like reference numerals refer to like portions of the embodiment shown in FIG. 1. In this embodiment, as seen from FIG. 3A, a weight 53 mounted on the backside of the conversion portion of the speaker unit 32 is similar to the weight 33 in FIG. 1 in the material and in that a coupling part 57 of the height 53 is coupled with the magnetic circuit 35 of the speaker unit 32 in order to reduce the thickness in the axial direction 32*a*, but different from the weight 33 in FIG. 1 in that a weighting part 59 is not provided on the entire periphery as shown in FIG. 3B. In order to increase the mass of the weight 38, the peripheral edge 59 of the weight 58 have a shape extended not only forward but also circumferentially.

The weighting part 58 of the weight 53 is not formed on the entire backside of the magnetic circuit 35 serving as a conversion portion, but formed within a predetermined partial region in a circumferential direction. For this reason, in the door 40 of the vehicle body as shown in FIG. 2, where the depth is short and the space for accommodating the door glass 43 is also required, the weight 53 can be further prevented from interfering with the door glass 43.

Since the weight 53 according to this embodiment is only partially arranged on the rear side of the speaker unit 32, where the speaker unit 32 is mounted in the door 40 of the vehicle body as shown in FIG. 2, the weight 53 can be prevented from interfering with the door glass 43, thereby effectively using the space. Further, even when an opening 60 is provided in the frame 36 of the speaker unit 32 as indicated by a double-dashed line in FIG. 3B, the weighting part 58 can be arranged so as not to face the opening 60. The opening 60 is provided in order to extend the frequency range of the sound reproduced by the speaker unit to the bass range, or in order to use the speaker in a full range.

As the frequency range of the reproduced sound become low, the displacement of the diaphragm 34 necessary to obtain the same sound pressure increases. This is because if the backside is closed by the frame 36, the stiffness of the closed air makes it difficult to displace the diaphragm 34. Where the speaker for vehicle 51 reproduces the range from the midrange including the main part such as human voice to the low frequency range lower than the midrange, if the frame 36 on the backside of the diaphragm 34 is closed, the pressure of the air confined in the space on the backside greatly increases. If the opening 60 is provided on the backside of the frame 36, the pressure on the backside of the diaphragm 34 can be dissipated externally from the frame 36. Since the weighting part 58 of the weight 53 is arranged in the area where the frame 36 is not opened on the backside, it does not influence the opening 60 for dissipating the pressure on the backside of the diaphragm 34.

Figure 4:
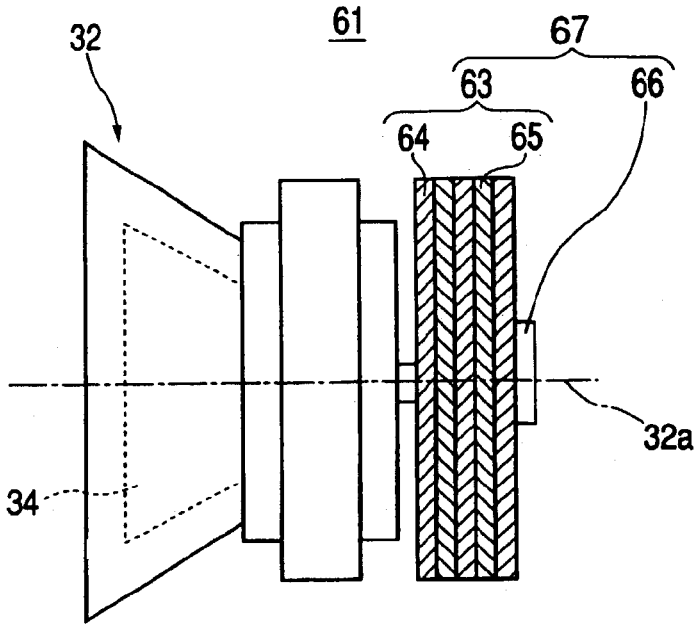
FIG. 4 is a side view, partially in section, of a speaker for vehicle according to still another embodiment of this invention.
Figure 5:
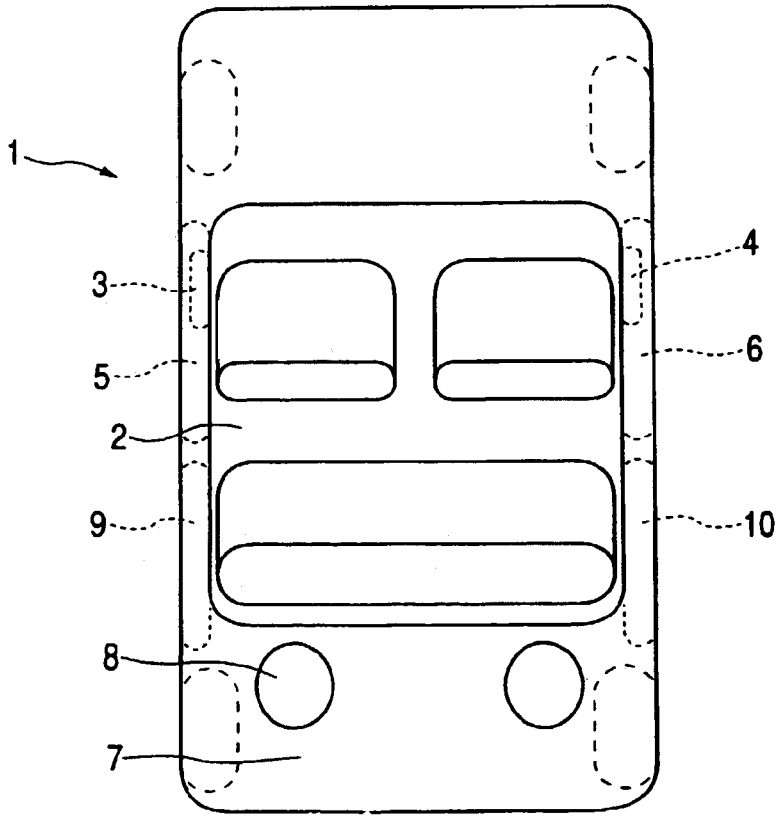
FIG. 5 is a schematic plan view showing positions where speaker for vehicles are conventionally mounted in a vehicle.

FIG. 4 shows a schematic configuration of a speaker for vehicle according to still another embodiment of this invention. In this embodiment, like reference numerals refer to like portions of the embodiment shown in FIG. 1. In this embodiment, as seen from FIG. 4, a weight 63 mounted on the conversion portion of the speaker 32 is composed of a plurality of stacked thin weight members 64 and 65, and a bolt 66. The weight members 64 and 65 can be stacked to the thickness of the depth. The plurality of weight members 64 and 65 are secured to the magnetic circuit 35 of the speaker unit 32 using the bolt 66. By using the thin weight members 64 and 65 thus combined, the speaker for vehicle 61 can be mounted on various vehicle doors.

For example, the weight member 64, which is the first member, can be commonly employed in such a manner that the diameter is extended and the edge on the outermost periphery is extended forward as in the embodiment shown in FIG. 1. The weight members 65 can be stacked on the weight member 64. The diameter of each weight member 65 may be the same with or different from the diameter of the weight member 64.

The weight member 64, which is the first member, may have a coupling part and a weighting part arranged partially in the circumferential direction as in the embodiment shown in FIGS. 3A and 3B. The weight members 65 can be stacked on the weight member 64. The weigh members 65 may have shapes extending partially in the circumferential direction or may have shapes extending whole area in the circumferential direction.

As understood from the description hitherto made, in accordance with this invention, the vibration of the diaphragm for generating an acoustic output which suffers from the counterforce from the air is suppressed by the weight which is mounted on the backside of the conversion portion and serves as a virtual ground, thereby improving the sound quality of the reproduced sound. The weight has a mass enough to serve as the virtual ground, and has a shape in which the length in the diameter direction extending perpendicularly to the depth is longer than the thickness in the depth direction extending toward the backside from the coupling part. For this reason, the speaker for vehicle can be installed in the portion of the door of the vehicle body.

In accordance with this invention, since the coupling part is coupled with the back of the conversion portion on a straight line which passes the center of gravity of the conversion portion, the sound quality can be effectively improved.

In accordance with this invention, with the thickness reduced in the depth direction, a sufficient mass can be obtained. Where the frequency range not including the bass range, such as the midrange of the main part such as human voice is reproduced, the frame can be provided with no opening on the backside. Therefore, using the space of the backside of the frame, the weight can be made thin in the vicinity of the coupling part but can have an increased mass at the edge of the weighting part.

In accordance with this invention, the weighting part of the weight is formed within a predetermined partial region in a circumferential direction. For this reason, the space of the vehicle body can be effectively employed to mount the weight.

In accordance with this invention, since the weighting part of the weight is arranged at an area where the frame is not opened on the backside, where a relatively low frequency range is reproduced, it does not influence the opening for dissipating the pressure on the rear side of the diaphragm.

In accordance with this invention, according to a vehicle, the thickness of the weight is adjusted to correspond to the depth assured in the space where the speaker for vehicle is accommodated, thereby improving the quality of the reproduced sound.

What is claimed is:

1. A speaker for a vehicle which is installable in a space adjacent to a passenger room in a vehicle body, comprising:

a diaphragm facing the passenger room;

a conversion portion having a magnetic circuit disposed on a backside of the diaphragm, the conversion portion converting an electric signal into a driving force for a mechanical displacement to be applied to the diaphragm; and a weight mounted on the backside of the conversion portion, herein the weight includes:

a coupling part coupled with a back part of the conversion portion; and a weighting part having a shape in which a length in a diameter direction extending perpendicularly to a depth direction that extends from the coupling part toward the back part is longer than that in the depth direction, and having a mass capable of suppressing a vibration of the conversion portion.

2. A speaker for vehicle according to claim 1, wherein the coupling part is coupled with the back part on a straight line which passes a center of gravity of the conversion portion and extends in a direction of the mechanical displacement to be applied to the diaphragm.

3. A speaker for vehicle according to claim 1, wherein the weighting part has a shape which extends in the diameter direction around the coupling part more externally than an outer periphery of the conversion portion, and has an edge located outside the outer periphery of the conversion portion and extending forward in a direction substantially parallel to the depth direction so as to cover at least a part of the outer periphery of the conversion portion.

4. A speaker for vehicle according to claim 1, wherein the weighting part is formed within a predetermined region in a circumferential direction around the coupling part.

5. A speaker for vehicle according to claim 1, wherein a frame supporting the diaphragm and the conversion portion has an opening on a back part thereof, and the weighting part is arranged at an area which does not face the opening.

6. A speaker for vehicle according to claim 1, wherein the weight includes a fixing member for fixing the weighting part to the conversion portion, the fixing member comprises the coupling part, and the weighting part comprises a predetermined number of thin weight plates which are stacked to each other.

7. A speaker for vehicle according to claim 1, wherein the weight includes a thin first weight plate having the coupling part and a predetermined number of thin second weight plates which are stacked to each other and fixed on the first weight plate.

* * * * *